United States Patent [19]

Thomassen

[11] 4,401,239

[45] Aug. 30, 1983

[54] TRANSPORT AND DISPENSING CONTAINER FOR LIQUID MATERIAL

[75] Inventor: Johan H. C. Thomassen, Zeist, Netherlands

[73] Assignee: Douwe Egberts Koninklijke Tabaksfabriek-Koffiebranderijen-Theehandel N.V., Utrecht, Netherlands

[21] Appl. No.: 270,812

[22] Filed: Jun. 5, 1981

[30] Foreign Application Priority Data

Jun. 6, 1980 [NL] Netherlands ..... 8003325

[51] Int. Cl.[3] ..... B65D 5/60

[52] U.S. Cl. ..... 222/183; 220/462; 229/15

[58] Field of Search ..... 222/94, 105, 143, 179.5, 222/183; 206/492; 220/403, 404, 416, 418, 462; 229/15, 27; 128/DIG. 24

[56] References Cited

U.S. PATENT DOCUMENTS

| | | | |
|---|---|---|---|
| 1,906,742 | 5/1933 | Coulapides | 229/27 |
| 3,007,608 | 11/1961 | Cox | 222/107 X |
| 3,352,472 | 11/1967 | Cummings et al. | 220/462 |
| 3,411,264 | 11/1968 | Farquhar | 220/404 X |
| 3,554,256 | 1/1971 | Anderson | 222/105 X |
| 3,756,471 | 9/1973 | Wissman | 222/156 |

FOREIGN PATENT DOCUMENTS

| | | |
|---|---|---|
| 1161713 | 8/1969 | United Kingdom . |
| 2002324 | 2/1979 | United Kingdom . |

*Primary Examiner*—F. J. Bartuska

*Attorney, Agent, or Firm*—Cushman, Darby & Cushman

[57] ABSTRACT

Container for transporting and likewise dispensing liquids, provided with a receptacle having the shape of a flexible plastics bag with a discharge spout, provided in a more rigid, supporting and enveloping box, a so-called bag-in-box package. It can be brought from a transport position, in which the flexible liquid bag with attached discharge spout is enclosed protectively in the enveloping box, in an operating position wherein, with avoidance of spilling of liquid through pressure on bag and spout, the liquid bag is likewise enclosed in the box, however the discharge spout extends in the container in such a way that it can be operatively combined with an operating mechanism disposed in a beverage vending machine, in order to dispensingly pump liquid from the bag.

6 Claims, 5 Drawing Figures

TRANSPORT AND DISPENSING CONTAINER FOR LIQUID MATERIAL

The invention relates to a transport and dispensing container for liquid material, i.e. all materials, also pastes, which can be transported through pumping effect. In particular the invention concerns such a container for beverage concentrates in beverage vending machines.

In applicant's Dutch patent application No. 78,08299 laid open to public inspection, corresponding with British patent application No. 2,002,324A, there is described a beverage vending machine wherein the liquid or paste-like beverage concentrate and the like, to be called subsequently liquid, to be dispensed, is contained in a flexible container having a resiliently deformable discharge spout which is designed as dispending hose. The machine is fitted with a mechanism for compressing the spout at will in such a way that, making use of non-return valves at the spout ends, liquid is pressed from the spout and upon the subsequent expansion of the spout, this is replenished from the container. The liquid containers are of the one-trip type and the vending machine is adapted for receiving the filled containers in such a way that the discharge spout is within reach of the compression mechanism in order to form jointly a dispensing pump. In view of the design of the transport and dispensing container, both during the packing for transport and during the positioning of a filled liquid container in a beverage vending machine, care should be taken since during the squeezing of the filled flexible container or the discharge spout, the non-return valves in the spout cannot prevent the pressing out of liquid.

U.S. Pat. No. 3,007,608 discloses a container for the transport and likewise the delivery of liquids, e.g. milk, provided with a thin flexible plastics bag or lining disposed in a more rigid, supporting container, both destined for a one-off operation. It concerns a so-called bag-in-box package, wherein the rigid envelope, mostly a cardboard box, ensures the required solidity during the transport and during the manipulation with the box, subsequently reducing substantially the chance of spilling.

It is the object of the invention to provide such a bag-in-box package, which is particularly suitable for use in a beverage vending machine of the type described in British patent No. 2,002,324A, in the sense that only a restricted number of simple steps is required for positioning a filled container in a vending machine, which can be performed without any problem by the supervisor of the machine.

According to the invention the bag-in-box package is characterized in that it can be brought from a transport position, in which the flexible liquid bag with the attached discharge spout is protectively enclosed in the enveloping box, can be brought in a use position, wherein—with avoidance of spilling by pressure on bag and spout, the liquid bag is likewise enclosed in the box, but wherein however the discharge spout projects from the package in such a way that it can be operatively combined with an operating mechanism disposed in a beverage vending machine in order to pump dispensed liquid from the bag.

Both during transport and during the positioning in a vending machine, only the box need to be engaged, so that spilling as a result of inadvertently squeezing the flexible container or the spout is excluded.

A number of conditions is set to such a bag-in-box package, in particular upon application in combination with a beverage vending machine.

The discharge spout has a length that is defined by the specific application, e.g. in a certain type of beverage vending machine, about 12 cm. The construction of the spout does not permit its being folded, rolled and the like, and if disposed at one end of the bag, the spout in the enveloping box will occupy a given box volume which may amount to 40% of the total box content. In connection with the above mentioned risk of spilling as a result of direct engagement of the bag or spout, a transport position as shown in FIG. 5 of British application No. 2,002,324A, wherein the spout is turned flatly against the bag, is less suitable.

Taking the above into account, in further elaboration of the invention, the liquid bag may have an elongate design with the discharge spout projecting transversely from the centre portion, while the box has two tubular portions which each enclose about half of the bag and which are so interconnected that, from the transport position wherein the bag is folded in U-shape, with the spout enclosed between the bag halves, they can be turned over to the use position wherein the bag again is folded in U-shape, but now with the spout projecting outwardly from the box.

In this embodiment it is possible to effect the transition from the transport position in the dispensing position of the dispensing spout without engagement thereby of the bag or the spout. Of the tubular box portions enclosing the bag halves, two sleeve walls lie adjacent each other both in the transport position and in the position of use and this wall assembly has the effect of an intermediate box wall which contributes to the total strength of the packing box, so that the box can be made of relatively thin material, which especially in case of a disposable article, is a major economic advantage. Furthermore the U-configuration of the bag in the transport position has an additional advantage. Specific liquids may be transported and stored in frozen condition. For instance certain types of coffee extract are not unfrozen until some time before positioning a filled concentrate container in a beverage vending machine. During the freezing-in liquid will expand and according as the horizontal cross-section of the enclosed liquid mass becomes greater, the chance of damage to an enveloping box package becomes greater. With the U-shaped liquid bag configuration the risk of damage to the box during the freezing-in of the liquid is minimized. The U-shaped bag configuration in the position of use furthermore is favourable in the sense that the bag, even at high speed, can be pumped substantially entirely empty, since the connection of the spout to the bag is always the lowest point of the bag.

Furthermore, according to the invention a spout passage may be provided in at least one of the box sleeve wall portions lying in the transport position adjacent each other, which passage, after turning over of the box halves to the use or supply position, lies at the exterior, so that the liquid level in the container can be supervised via said passage.

In a preferred embodiment of the container according to the invention, the tubular box portions are interconnected at their open ends by a folding wall composed of panels that are interconnected and connected to the sleeves via hinge lines in such a way that the folding wall in the use position extends over the open sleeve end in sealing relationship and in the transport position is folded back over itself and being disposed underneath a removable cover shutting off the sleeves in the transport position, while the discharge spout extends through the folding wall and with the spout passage in the respective sleeve sidewall continuing into the folding wall.

Thus, starting from the transport position, wherein the discharge spout extends through the folding wall folded back over itself inwardly into the container between the U-shaped folded back portions, the hole being shut-off by the removable cover, for the purpose of transferring the container from the above described transport position to the position of use, the cover can be removed and the two tubular box portions can be turned over mutually through 360°, so that the folding wall folded so far is stretched and the discharge spout effects a swiveling movement through 180° relatively to both box halves, thereby moving through the passage into the adjacent sleeve wall and the adjoining opening in the folding wall. In the position of use, the flexible liquid container is again entirely protected by box material, except for the spout passage, but the discharge spout extends through the folding wall in outward direction and the container with spout directed downwards may be positioned in a beverage vending machine, whereby it should only be ensured that the spout passage in the sleeve sidewall is so arranged that the liquid level is perceptible from the outside.

Preferably, the discharge spout is fitted with means for fixing the spout in the folding wall, so that in case of stretched folding wall in the position of use, the level of the spout is fixed relatively to the pump operating mechanism in the beverage vending machine, which is important for ensuring each time equal dispensing portions, while likewise resistance is offered to any pulling movements of the liquid bag, which may occur in case of rapid emptying thereof. For instance a coffee vending machine should be capable under certain conditions of dispensing up to 3600 cups per hour.

Although in the above the container according to the invention is described in relation to a beverage vending machine, it will be clear that the invention is not restricted to this specific application. The invention can be applied to any disposable container for liquid or paste-like material which should be dispensed portionwise or continuously, such as fruit juices, liquid soap and the like.

One embodiment of the transport and dispensing container for liquid material will now be described, by way of example, with reference to the accompanying drawings, wherein FIG. 1 is a perspective view of the container in the transport position;

Figure 1:
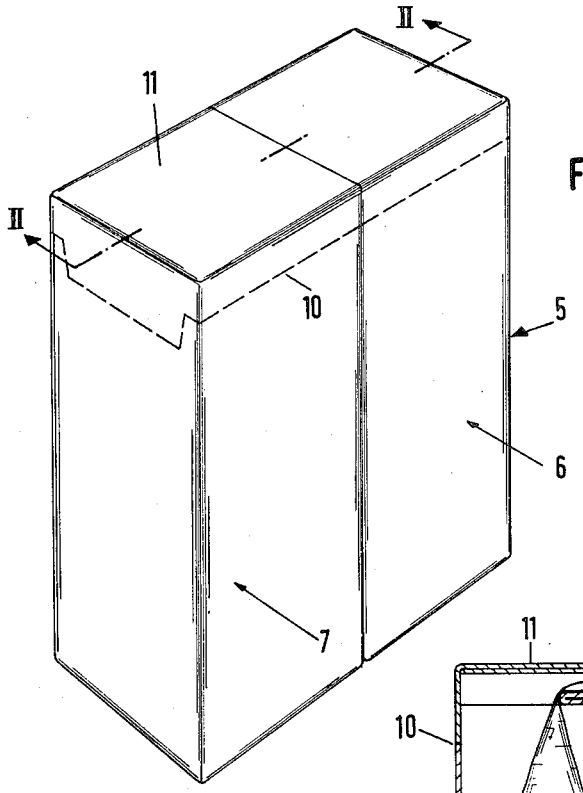

According to the drawing, the bag portion of the bag-in-box package is designed as an elongated tube 1 having a discharge or dispensing spout 2 of flexible deformable material extending transversely to the central portion thereof having on either side non-return valves 3 and 4. When the tubular central portion of the spout 2 is squeezed tight, liquid present therein can be pressed out via the non-return valve 4 at the free spout end, while the other valve 3 is closed. As soon as the spout is afforded an opportunity of expanding again, the downstream non-return valve 4 is closed and the spout will be replenished via the other non-return valve 3 from the flexible reservoir 1.

As shown in the Figures, the transport bag 1 is enclosed in a box 5 having two tubular portions 6 and 7, which each envelop a part of the tubular bag 1. In the transport position shown in FIGS. 1 and 2, the bag 1 is enclosed in U-shaped relationship by the box sleeves 6 and 7 adjoining each other with the sleeve sidewalls 8 and 9. The assembly is shut-off at the top by a cover 11 that is either entirely loose or removable by tear lines 10. In the transport position shown in FIGS. 1 and 2, the tubular box portions 6 and 7 are interconnected by the removable cover and by a folding wall 12 which in the transport position is folded back about itself and which is disposed underneath the cover 11. The discharge spout 2, which is fixed by means of flanges 13 and 14 relative to the folding wall 12, extends inwardly between the U-shaped oriented portions of the bag 1 in the sleeve 6.

Figure 2:
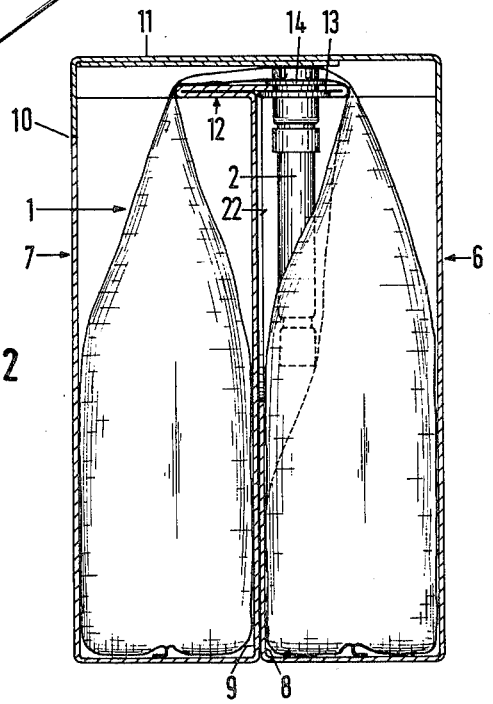
FIG. 2 is a cross-section on the line II—II in FIG. 1.
Figure 3:
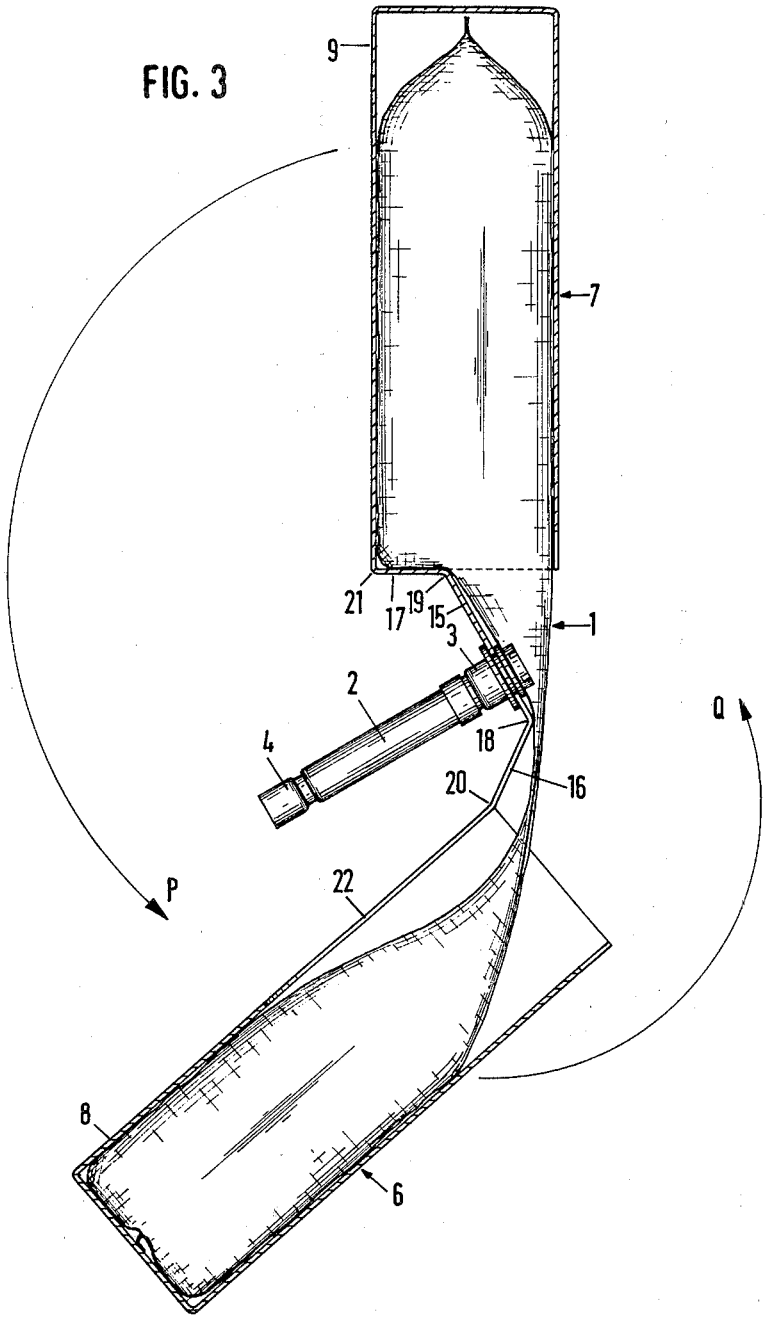
FIG. 3 shows in cross-section the turning over of box portions from the transport position to the use position.
Figure 4:
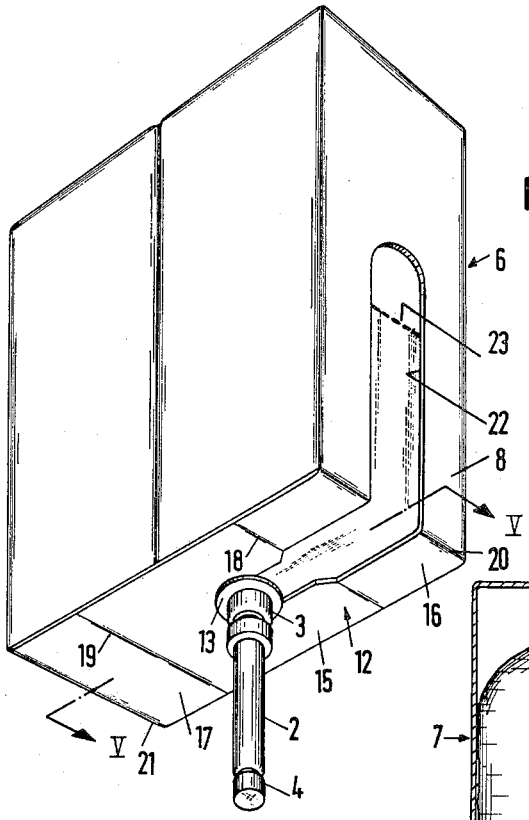
FIG. 4 is a perspective view of the container in the use or dispensing position and FIG. 5 is a cross-section on the line V—V in FIG. 4.
Figure 5:
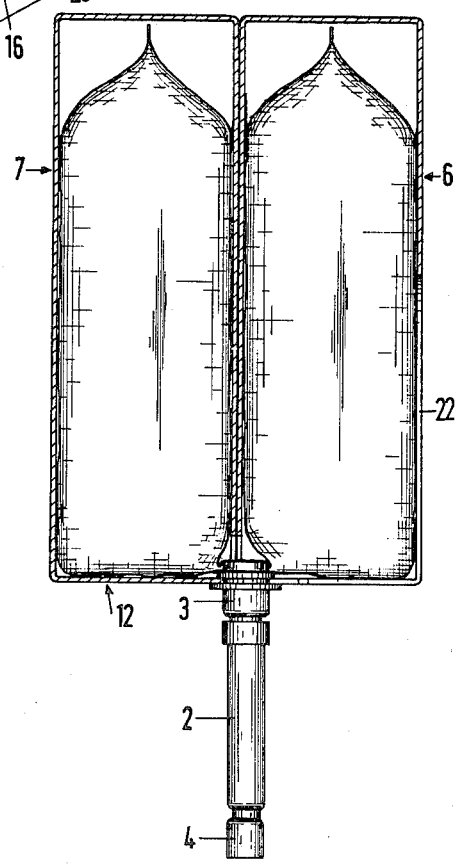

FIG. 3 shows the turning over relative to each other of the tubular box portions 6 and 7 for the transformation from the transport position shown in FIGS. 1 and 2 to the use or dispensing position according to FIGS. 4 and 5.

For this transformation, the container as depicted in FIG. 2, is turned after removal of the cover 11, so that the box sleeve 6 shown in FIG. 2 comes to lie at the left-hand side and the sleeve 7 at the right-hand side. Subsequently (see FIG. 3) the sleeve 6 is swiveled downwardly according to the arrow P and, as shown in FIG. 3, anti-clockwise, according to the arrow Q, so that the sleeve 6 again comes to lie at the right-hand side of the sleeve 7, as shown in FIGS. 4 and 5. The spout 2 now extends through the folding wall 12 which is now entirely stretched, in outward direction. The folding wall 12 is composed of a central panel 15 and two side panels 16 and 17, which are interconnected by hinge lines 18 and 19, while the side panels 16 and 17 are connected to the adjoining sleeve walls 8 and 9 by hinge lines 20, 21. Again with reference to FIG. 3, during the turning movement of the sleeve 6 according to the arrow P, substantially a swiveling movement will be effected about the hinge line 19, while in the last part of the swiveling movement according to the arrow Q, swiveling about the hinge line 18 will take place. In the sleeve wall 8 there is provided a spout passage 22 which is continued in the folding wall 12 across the side panel 16 as far as into the central panel 15 around the place where the spout 2 extends through the panel 15. As clearly shown in FIG. 3, via said passage 22, the spout 2, extending in the transport position shown in FIG. 2 into the sleeve 6, may swivel outwardly. The passage 22 functions in the position of use depicted in FIG. 4 as "gauge glass", so that the supervisor of the beverage vending machine can detect immediately the "liquid level" 23.

A thus designed container furthermore is excellently suitable for highly automated manufacture thereof.

For instance, the sleeves 6 and 7 may lie in co-planar and adjacent relationship with the open ends directed towards each other and the folding wall 12 completely stretched therebetween. Assuming the sleeves 6 and 7 with the then upwardly directed sidewalls open, the tubular container 1 may then be lowered therein with the spout 2 directed vertically downwards. After closure of the said upwardly directed sleeve walls, the assembly can be engaged underneath the folding lines 18 and 19 and the whole can be lifted. The assembly then occupies the position shown in FIG. 2, be it that the cover 11 has to be positioned yet in some way or other. Thus, also during the closure of the container, even before the contents are frozen, stored and transported, the direct engagement of the liquid-filled flexible container 1 can be minimized. The box may be made of a blank, i.e. one punched sheet of cardboard and the like provided with folding lines.

I claim:

1. A container for transporting and likewise dispensing liquids, provided with a receptacle having the shape of a flexible plastics bag with a discharge spout, provided in a more rigid, supporting and enveloping box, a so-called bag-in-box package, characterized in that it can be brought from a transport position, in which the flexible liquid bag with attached discharge spout is enclosed protectively in the enveloping box, in an operating position wherein, with avoidance of spilling of liquid through pressure on bag and spout, the liquid bag is likewise enclosed in the box, however the discharge spout extends in the container in such a way that it can be operatively combined with an operating mechanism disposed in a beverage vending machine, in order to dispensingly pump liquid from the bag, and further characterized in that the liquid bag has an elongate design with in the central portion the discharge spout projecting transversely therefrom, while the box has two tubular portions, each enclosing about half of the bag and which are interconnected in such a way as to be turned over from the transport position, wherein the bag is folded in U-shape, with the spout enclosed between the bag halves, to the supply position, wherein the bag again is folded in U-shape, but now with the spout projecting outwardly from the box.

2. Container according to claim 1, characterized in that of the tubular box portions enclosing the bag halves, both in transport position and in supply position, two walls lie against each other as a double box intermediate wall.

3. Container according to claim 1 or 2, characterized in that in at least one of the tubular box wall portions lying against each other in the transport position, there is provided a spout passage which, after turning over of the box halves to the operating or supply position, lies at the exterior, so that the liquid level in the receptacle can be supervised via said passage.

4. Container according to claim 1, characterized in that the tubular box portions at their open ends are interconnected by a folding wall consisting of panels that are connected mutually and to the tubes via hinge lines in such a way that the folding wall in the operating position extends sealingly over the open tube ends and in the transport position is folded back over itself and is disposed underneath a removable cover shutting-off the tubes in the transport position, while the discharge spout extends through the folding wall and the spout passage in the respective tube sidewall continues into the folding wall.

5. Container according to claim 4, characterized in that the discharge spout is provided with means for fixing the spout in the folding wall, so that in case the folding wall is stretched in the operating position, the level of the spout is fixed relatively to the pump operating mechanism in the beverage vending machine.

6. A container for transporting and dispensing liquids comprising an elongated flexible plastics bag having a central portion fitted with a discharge spout projecting from said central portion; a box of more rigid construction than said bag for supporting and enveloping said bag, said box having two tubular portions such enclosing about one half of the bag and said box having a folding wall through which said discharge spout projects, said folding wall interconnecting said two tubular portions such that said tubular portions can swing approximately 180° between a transport position in which said tubular portions are generally parallel and in which said bag is folded in a U-shaped with said spout enclosed between said bag halves and a dispensing position in which said tubular portions are generally parallel and in which said bag is folded in a U-shape with said spout projecting outwardly from the box.

* * * * *